US010086381B2

(12) United States Patent
Cottam et al.

(10) Patent No.: US 10,086,381 B2
(45) Date of Patent: Oct. 2, 2018

(54) GRINDER MILL AIR FILTER

(71) Applicants: Steven Cottam, Ivins, UT (US); Phillip Dietz, Saint George, UT (US)

(72) Inventors: Steven Cottam, Ivins, UT (US); Phillip Dietz, Saint George, UT (US)

( * ) Notice: Subject to any disclaimer, the term of this patent is extended or adjusted under 35 U.S.C. 154(b) by 0 days.

(21) Appl. No.: 15/603,074

(22) Filed: May 23, 2017

(65) Prior Publication Data

US 2017/0259273 A1 Sep. 14, 2017

Related U.S. Application Data

(62) Division of application No. 14/207,670, filed on Mar. 13, 2014.

(51) Int. Cl.

| | |
|---|---|
| ***B02C 23/00*** | (2006.01) |
| ***B02C 23/10*** | (2006.01) |
| ***B02C 23/26*** | (2006.01) |
| ***B02C 7/04*** | (2006.01) |
| ***B02C 7/13*** | (2006.01) |
| ***B02C 7/18*** | (2006.01) |
| ***B02C 11/04*** | (2006.01) |
| ***B02C 18/18*** | (2006.01) |
| ***B02C 25/00*** | (2006.01) |

(52) U.S. Cl.

CPC ..... *B02C 23/10* (2013.01); *B02C 7/04* (2013.01); *B02C 7/13* (2013.01); *B02C 7/184* (2013.01); *B02C 11/04* (2013.01); *B02C 18/18* (2013.01); *B02C 23/26* (2013.01); *B02C 25/00* (2013.01); *B02C 2018/188* (2013.01); *Y10T 29/49716* (2015.01); *Y10T 29/49995* (2015.01)

(58) Field of Classification Search

CPC .. B02C 7/184; B02C 7/04; B02C 7/13; B02C 23/06

USPC ..... 241/79.1, 184, 188.1

See application file for complete search history.

(56) References Cited

U.S. PATENT DOCUMENTS

| | | | | | |
|---|---|---|---|---|---|
| 3,497,144 | A | | 2/1970 | Hint | |
| 4,203,555 | A | | 5/1980 | Dickson | |
| 4,213,571 | A | * | 7/1980 | Deardorff | B02C 13/288 241/101.8 |
| 4,422,578 | A | | 12/1983 | Scott | |
| 4,586,658 | A | * | 5/1986 | Eisenegger | B02C 13/13 241/19 |
| 5,660,339 | A | | 8/1997 | Scott | |
| 5,826,807 | A | * | 10/1998 | Csendes | B01D 45/14 241/162 |
| 5,850,977 | A | * | 12/1998 | Csendes | B01D 45/14 241/162 |
| 5,968,997 | A | * | 10/1999 | Luniewski | B01F 13/0001 204/157.15 |
| 6,135,371 | A | * | 10/2000 | Csendes | B01D 53/00 241/15 |

(Continued)

*Primary Examiner* — Faye Francis

(74) *Attorney, Agent, or Firm* — Zachary Renstrom

(57) ABSTRACT

A rotary grinding mill for that improves the rotary grinding mill process. A milling assembly that comprise an offset ripper blades to limit the noise applied to the unit, cutting edges on the milling assembly blades, and an trailing blade edge that is angled creating a milling fan blade. The milling fan blade creates an air flow through the mill assembly. A collection container that utilized a plurality of cyclonic air flow patterns and filters to remove particles from the air.

3 Claims, 7 Drawing Sheets

(56) References Cited

U.S. PATENT DOCUMENTS

| | | | | |
|---|---|---|---|---|
| 6,394,371 | B1 * | 5/2002 | Ribardi | B02C 19/005 241/16 |
| 6,713,112 | B1 * | 3/2004 | Lucas | B01D 45/14 426/463 |
| 7,828,236 | B2 * | 11/2010 | Booth | B02C 13/284 241/79.1 |
| 2003/0111568 | A1 * | 6/2003 | Coert | B02C 13/08 241/79.1 |

* cited by examiner

GRINDER MILL AIR FILTER

DOMESTIC PRIORITY

This application is a DIVISIONAL of and claim priority to U.S. application Ser. No. 14/207,670 filed Mar. 16, 2013 the contents of which are incorporated by reference in its entirety.

BACKGROUND OF THE INVENTION

Field of the Invention

A rotary grinding mill that increases the effectiveness of the grinding process and the collection process, while minimizing the noise, air pollution and vibration generated by the grinding mill.

Prior Art

The invention relates to a grinding mill. A grinding mill is the process of applying a mechanical force to a grain to overcome the interior bonding forces of the grain. The mechanical force causes the grain to break into smaller pieces. Grinding food serves several purposes such as increasing the flavor, the texture, and nutritional value of the food.

The concept of grinding or milling food particles dates to prehistoric man. Currently, there are several different types of grinding mills available. One very popular type of grinding mill is a rotary mill that comprises two grinding discs contained within a housing unit. Generally, there is a stationary grinding disc that has radially spaced concentric rows of blades extending from the face of the disc. A second rapidly rotational grinding disc that also has radially spaced concentric rows of blades extending from the face of the rotating grinding disc. The blades from the stationary grinding disc, and the blades from the rotating grinding disc are oriented in such that the concentric rows of blades of the rotation disc are disposed between the concentric rows of blades of the stationary disc thereby provide alternating rows of radially spaced blades.

Rotary mills have several limitations. One such limitation is the excess noise and vibration. The noise and vibration are generally created by the motor, the movement of the grinding disc, and the sounds of the material being milled. In addition, rotary mills are very bulky and cumbersome to store. Another problem is the poor results from the grinding method. Generally, users prefer the grain to be uniformly and finely ground. When food particles have not reached the desired size, the users may be required to send the food products through the mill several times before achieving the correct results. Lastly, the milling process creates an excessive amount of fine particles which are exhausted into the air. All these limitations have caused users to stop using rotary mills.

Several prior inventions have made attempt to overcome these limitations. In Scott, U.S. Pat. No. 4,422,578 attempted to resolve the limitation of particles suspended in the air. Scott provided an exhaust device that created a helical movement of the air. In addition, Scott added a foam filter. However, the helical movement of the air as taught in Scott was not effective and the foam filter becomes quickly clogged. Also, Scott did not even attempt to eliminate the other limitations of rotary mills.

Scott-Black, U.S. Pat. No. 5,660,339 attempted to improve the quality of the grinding mill by controlling the amount of grain fed to the milling disc. Scott-Black showed a method for controlling the volume of grain fed into the milling discs. Scott-Black included a feed tube which a user could adjust to control the flow of grain. However, the feed tub was separate from the control switches, and requires the mill to create vibration to allow the grain to feed through the tube. Scott-Black did include a collection system that used a revised helical movement of air and a foam filter to separate particles from the discharged air. While the Scott-Black invention did remove more particles than Scott, it is still not effective enough to prevent the foam filter become clogged frequently. Thus, requiring the foam filter to be removed and cleaned excessively. Scott-Black failed to teach anything that would address the limitation of noise, vibrations, or storage. In Scott-Black, the mill actually describes a method to create an unbalance milling disc to create vibrations. The additional vibration resulted in additional noise. Scott-Black also added a collection container, thus adding to the limitation of minimizing the area required to store the mill.

Although the prior art did attempt to minimize the described limitations, the prior art did not resolve the limitation adequately. In spite of the previous efforts, there remains a need for a rotary mill that improves the grinding process that creates a uniform, finely milled grain, that limits the noise and vibration, decreases the air particles discharged, and is minimizes the area required to store the mill.

SUMMARY OF THE INVENTION

It is a principal object of the invention to provide a rotary grinding mill that improves the grinding process, creating a uniform finely ground material by increasing the effectiveness of the rotary grinding process. Allowing the user to easily control the amount of grain feeding into the rotary milled grain. Another object is to provide a collection container that receives the air and ground material and effectively filters particles out of the air. Another advantage is to provide a rotary mill that limits the noise and vibration by allowing an easier way to balance the grinding discs and by controlling the air flow through the mill that includes several noise buffers. In accordance with another aspect of the invention, is to provide a means to limit the area required to store the mill by combining the mill into a single enclosed unit.

DESCRIPTION OF THE DRAWINGS

The invention may take form in certain parts and arrangement of parts, and preferred embodiment of which will be described in detail in the specification and illustrated in the accompany drawing, which for a part hereof.

DETAILED DESCRIPTION OF THE PREFERRED EMBODIMENTS

Figure 1:
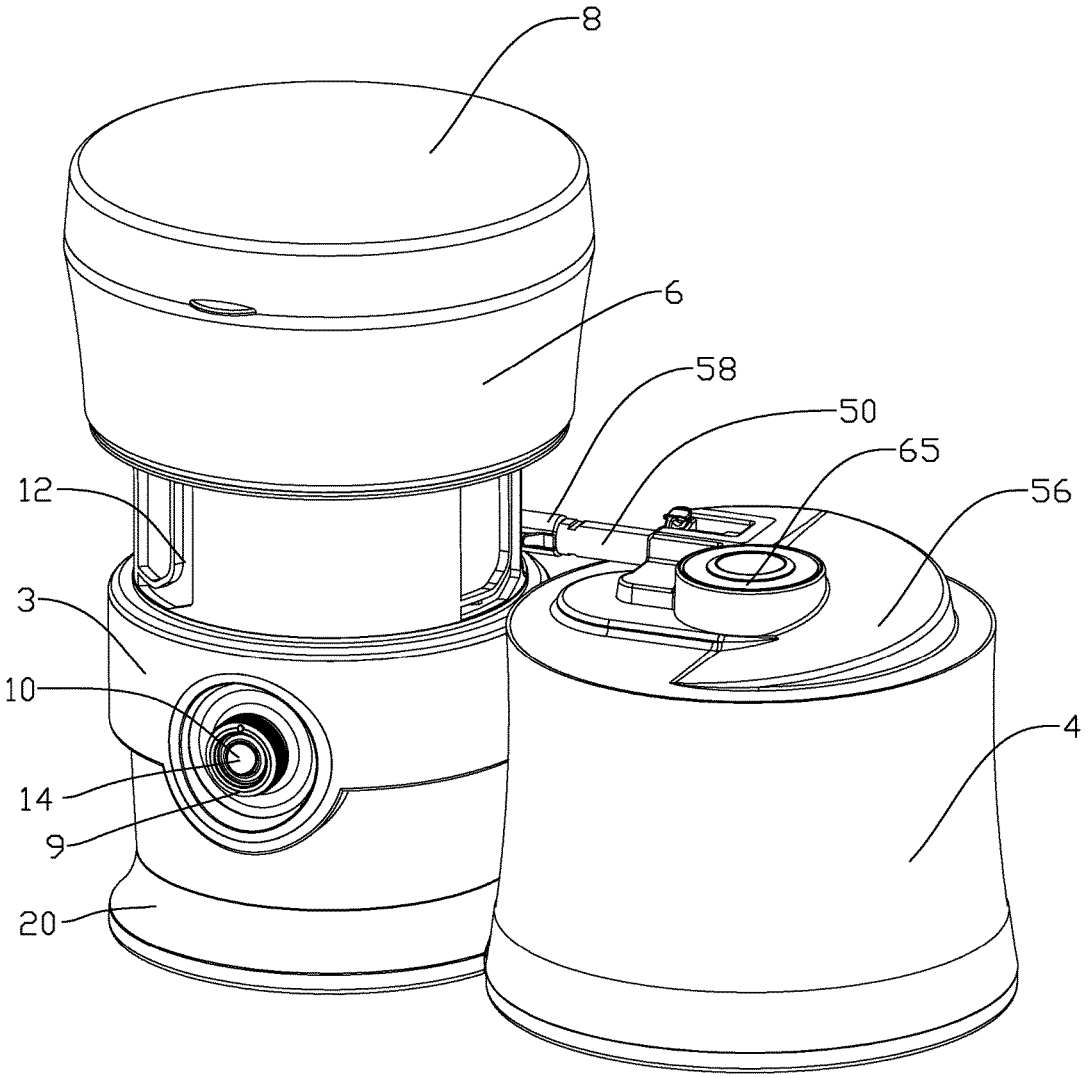
FIG. 1 shows a side plan view showing of the mill in an operational configuration, with the hopper extended above the mill housing and the collection container connected to the discharge port.

The following discussion describes embodiments of the invention and several variations of these embodiments. This discussion should not be construed, however, as limiting the invention to these particular embodiments. Practitioners skilled in the art will recognize numerous other embodiments as well. It is not necessary that the grinding mill filter have all of the features described below with regard to the specific embodiments of the invention shown in the figures.

In the flowing description of the invention, certain terminology is used for the purpose of reference only, and is not intended to be limiting. Terms such as "upper", "lower", "above", and "below," refer to directions in the drawings to which reference is made. Terms such as "inward" and "outward" refer to directions towards and away from, respectively, the geometric center of the component described. Terms such as "side", "top", "bottom," "horizontal," and "vertical," describe the orientation of portions of the component within a consistent but arbitrary frame of reference which is made clear by reference to the text and the associated drawings describing the component under discussion. Such terminology includes words specifically mentioned above, derivatives thereof, and words of similar import.

Referring to FIG. 1, a mill 2 embodying features of the present invention comprises a hopper 6, a mill housing 3, a mill assembly 22, a motor 16, and a collection container 4. The mill housing 3 encases the mill assembly 22 and the motor 16. In operation, the hopper 6 extends above the mill housing 3 and directs grain into the mill assembly 22. The hopper 6 includes a hopper lid 8. The hopper lid 8 protects the grain when stored in the hopper 6 and helps to dampen noise. The hopper lid 8 is connected to the hopper 6 by means of a hinge connection 7. The collection container 4 collects and stores the milled grain or flour (not shown). The collection container 4 has an open top end 83. A removable container lid 56 connects to the collection container 4 and completely covers the open top end 83. The connection between the container lid 56 and collection container 4 forms an air tight seal that is removable by a user.

Figure 2:
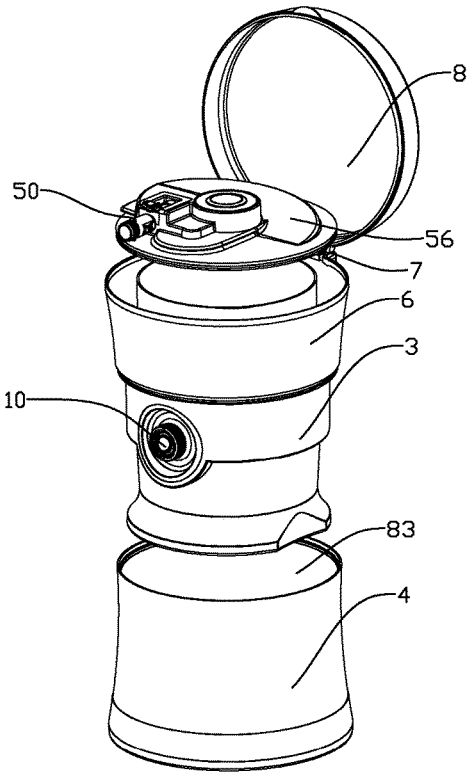
FIG. 2 shows a side exploded view of the mill in a storage configuration.
Figure 3:
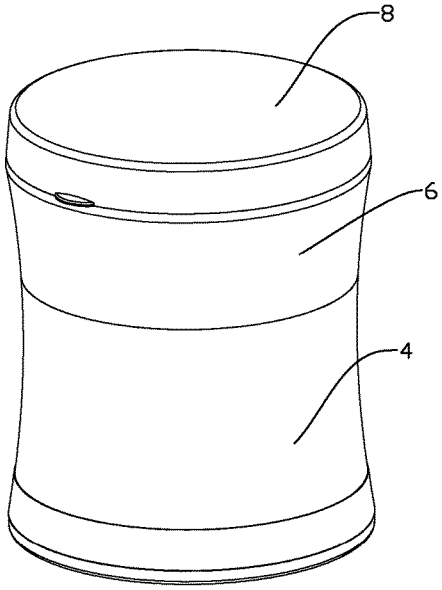
FIG. 3 shows a side view of the mill in a storage configuration.

As seen in FIGS. 2 and 3, the mill 2 may be combined into a single storage unit. The mill housing 3 has an outer circumference slightly less than the inner circumference of the collection container 4, such that the mill housing 3 may be placed inside the collection container 4. The hopper 6 retracts towards and along the longitudinal axis of the mill housing 3 such that it reduces the overall height of the mill 2. At least one hopper guide 12 is located on the mill housing 3. The hopper guides 12 allows the hopper 6 to slide easily along the mill housing 3. The hopper guides 12 turn at the top and bottom such that it prevents the hopper 6 from moving while in operation or when the mill 2 is stored. A deliberate force by the user is required to move the hopper 6 from the stored configuration or the operation configuration. An electrical cord (not shown) is stored in the base of the mill housing 3.

FIG. 2 shows an exploded version of the mill 2 in the storage configuration. The mill housing 3 is placed inside the collection container 4. The hopper 6 is lowered in the stored configuration. The container lid 56 is removed from the collection container 4 and placed inside the hopper 6. The hopper lid 8 is then closed. FIG. 3 best illustrates the mill 2 when in the final storage configuration.

Figure 4:
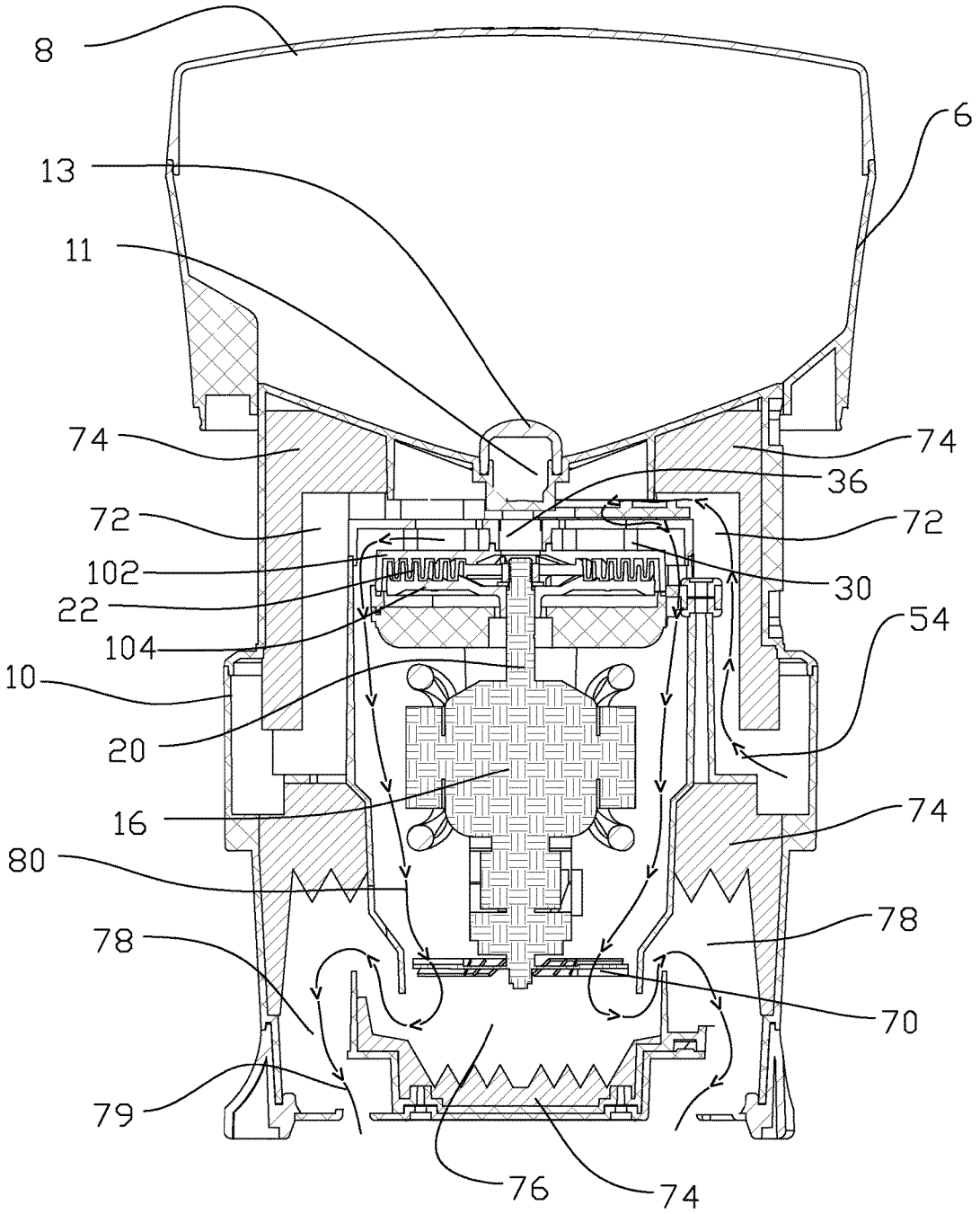
FIG. 4 shows a profile sectional view of the hopper, milling house and the air flow pattern through the mill housing.

Unless otherwise noted, the remaining description will assume that the mill 2 is in the operational configuration. As described above, the hopper 6 stores the grain or food products. As shown in FIG. 4, the sides of the hopper 6 and top of the mill housing 3 are sloped to direct the grain to a hopper outlet 11. The opening of the hopper outlet 11 is partially covered with a hopper cap 13. The hopper cap 13 prevents larger objects from entering the milling assembly 22 and prevents the user from touching the milling assembly 22 to avoid injury. In addition, the hopper cap 13 reduces noise from the milling assembly 22. The side of the hopper cap 13 is open to allow grain to flow freely into hopper outlet 11 and into the mill assembly 22 through a mill assembly port 35. Those skilled in the art will recognize the many different shapes and materials that may be used for the hopper 6 and mill housing 3.

Figure 5:
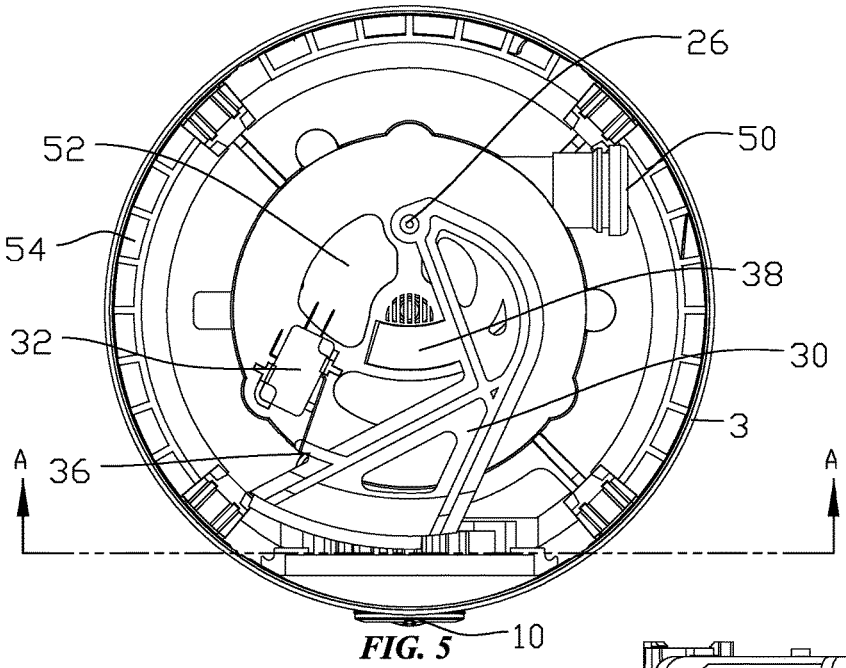
FIG. 5 shows a top profile sectional view of the milling housing showing a perspective view of the valve and pressure switch.
Figure 6:
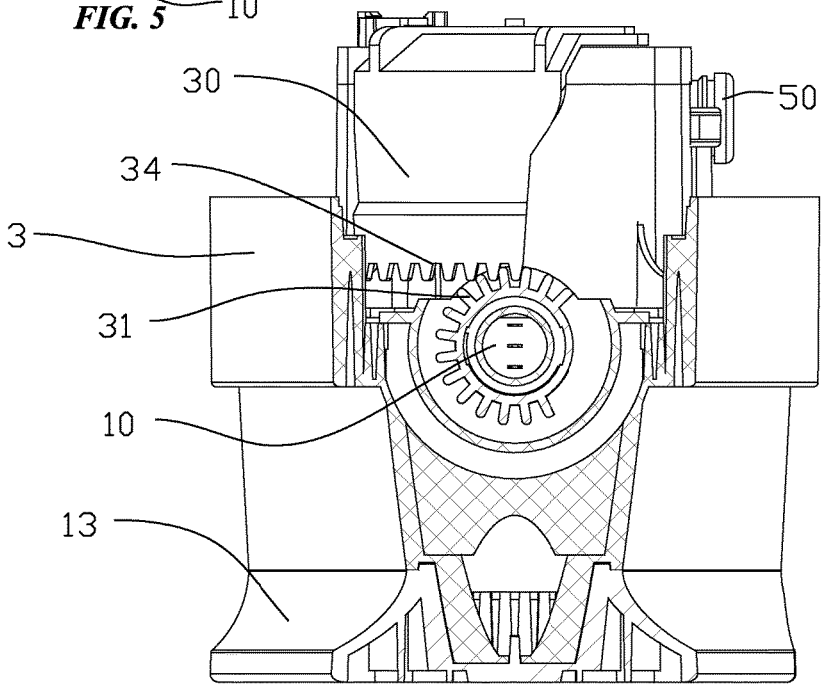
FIG. 6 shows a profile sectional view taken along the line A-A of FIG. 5 showing the inner action of the controller and valve.

As shown in FIG. 5, the flow of grain from the hopper 6 to the mill assembly 22 is regulated by a valve 30. The valve 30 is disposed between the hopper outlet 11 and the mill assembly port 35. The valve 30 comprises a rotation point 26, a valve gate 38, a switch arm 36 and a valve gear 34. The valve 30 communicates with a controller 10 located on the side of the mill housing 3. The controller 10 includes a power button 14 and a dial 9. The power button 14 controls the electrical power to the entire mill 2. The dial 9 includes several dial gears 31 that corresponds with the valve gears 34. When the dial 9 is rotated, the dial gears 31 communicates with the valve gears 34 causing the valve 30 to rotate about the rotation point 26. When the valve 30 is rotated, the valve gate 38 is removed from the mill assembly port 35 which allows the grain to flow from the hopper 6 into the mill assembly 22. The user is able to control the volume of grain feeding into the mill assembly 22 by adjusting the rotation of the dial 9. FIG. 5 show the valve 30 in the off or closed configuration.

Located inside the mill housing 3 is a pressure switch 32. When the valve 30 is in the off position, the switch arm 36 applies a force to the pressure switch 32. As described above, when the dial 9 is rotated, the valve 30 rotates. As the valve 30 rotates, the switch arm 36 releases the pressure from the pressure switch 32 allowing power to the motor 16.

The mill assembly 22 comprises a stationary grinding disc 102 and a rotational grinding disc 104. The stationary grinding disc 102 is sometimes referred to as a stator, and is attached to the mill housing 3. The rotational grinding disc 104 is attached to the motor 16 by means of a shaft 20. The shaft 20 is positioned in a shaft port 15 located in the center of the rotational grinding disc 104. The motor 16 is attached to the mill housing 3. The rotational grinding disc 104 will spin at speeds between 10,000 to 35,000 rotations per minute. The rotational speed and torque of the motor 16 is such as to create sufficient torque that is required to mill the grain. The mill assembly 22 is generally constructed out of steel or other higher strength material that can withstand the high speeds and forces exerted during operation.

Both the stationary grinding disc 102 and rotational grinding disc 104 have a plurality of grinding blades 112. The stationary grinding disc 102 has radially spaced concentric rows of blades 112 extending therefrom in a first axial direction. The rotational grinding disc 104 has radially spaced concentric rows of blades 112 extending therefrom in a second opposing axial direction. The blades 112 on the rotational grinding disc 104 and the blades 112 on the stationary grinding disc 102 are oriented in a confronting axial alignment such that at least some of the concentric rows of blades 112 of the rotational grinding disc 104 are disposed between the concentric rows of blades 112 of the stationary graining disc 102 thereby provide alternating rows of radially spaced blades 112.

The blades 112 have a face edge 120 and a rear face 124. The face edge 120 of each blade row is non-perpendicular to the radius of the milling assembly. The angle of the face edge 120 is between 45 to 89 degrees, creating a cutting edge 126 similar to a knife blade. The cutting edge 126 allows the grain to be cut instead of sheared.

Figure 7:
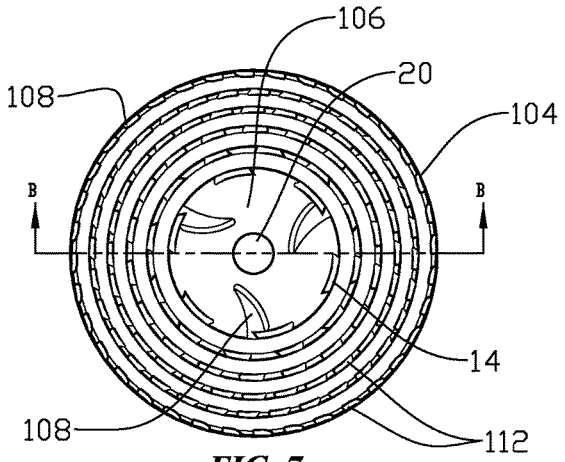
FIG. 7 a top view of the rotational grinding disc showing the cracking chamber and the concentric row of blades.

As shown in FIG. 7, located in the center of the mill assembly 22 is a cracking chamber 106. Located in the cracking chamber 106 is a plurality of rippers 108. The rippers 108 located on the stationary grinding disc 102 extend in a first axial direction in the center portion of the stationary grinding disc 102. The rippers 108 located on the rotational grinding disc 104 extend from a second opposing axial direction. The height of the rippers 108 is slightly half the distance between the face of the stationary grinding disc 102 and the face of the rotational grinding disc 104 such that when the rippers 108 on the rotational grinding disc 104 rotate past the rippers 108 on the stationary grinding disc 102, the rippers 108 slide past the opposing rippers 108. Any grain material located between two passing rippers 108 is sheared in half.

Figure 9:
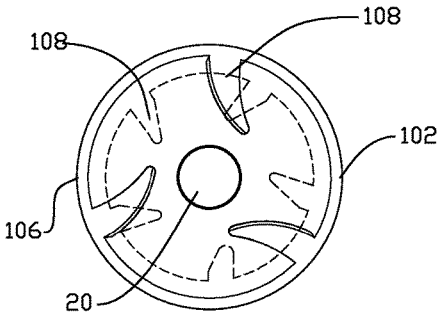
FIG. 9 shows an elevated view of the cracking chamber, the upper rippers on the stationary grinding disc as dash line.

As shown in FIG. 9, the rippers 108 located on the rotational grinding disc 104 have an offset number of rippers 108 as the number of rippers 108 located on the stationary grinding disc 102. The differing number of rippers 108 allow that when the leading edge of one of the rippers 108 located on the rotational grinding disc 104 and the leading edge of a ripper 108 on the stationary grinding disc 102 come in contact, while no other rippers 108 are interacting. The offsetting of the ripper 108 prevents wear on the motor 16 and limits the vibration and noise. The leading face of the ripper 108 on the rotational grinding disc 104 is arc such to force both air and grain material into the blades 112.

Figure 8:
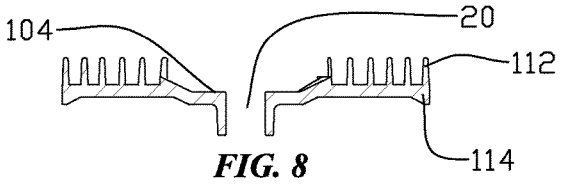
FIG. 8 shows a profile sectional view taken along the line B-B of FIG. 7 showing rotational grinding disc.
Figure 10:
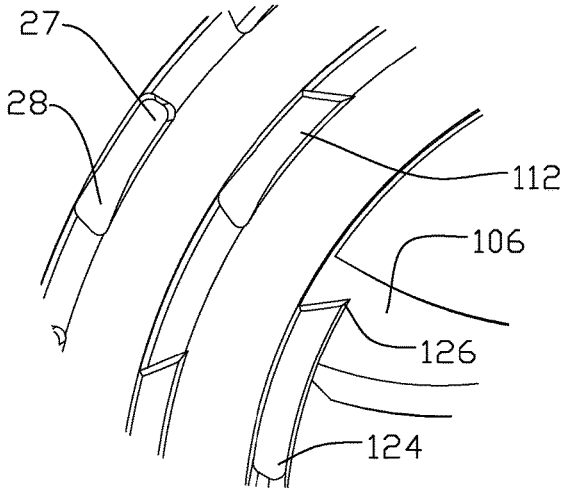
FIG. 10 shows a top view of the blades located in the milling assembly near the cracking chamber.

Proper balancing of the rotational grinding disc 104 is crucial to reducing both noise and vibration. Traditionally, the rotational grinding disc 104 is balanced by drilling out material located on the rotational grinding disc 104. However, this drilling results in weak spots. As shown in FIG. 8, located on the base of the rotational grinding disc 104 is a balancing edge 114. During balancing of the rotational grinding disc 104, a portion of the balancing edge 114 may be removed, without the need to drill holes in the rotational grinding disc 104.

Figure 11:
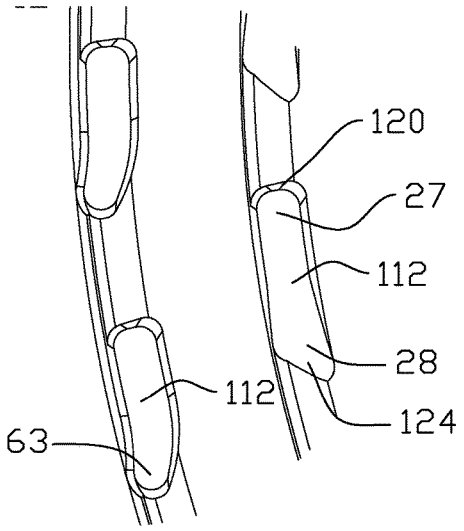
FIG. 11 shows a top view of the blades located on the outer circumference of the rotational grinding disc showing proximal end of the blade is angled from the longitudinal axis of the blade creating a fan blade.

The blades 112 have a proximal end 27 and a distal end 28. The proximal end 27 is generally the front half the blade 112 containing the portion of the blade 112 that strikes the grain and the face edge 120. The distal end 28 is generally the back half end of the blade 112 and located on the opposite end of the longitude axis of the blade 112 from the proximal end 27. One skilled in the art will recognize that the dividing line between the proximal end 27 and the distal end 28 may vary and not necessarily the center of the blade 112. The outer most concentric row of blades 112 on the rotational grinding disc 104 and the proximal end 27 of the blades 112 are angled from the longitude axis of the blade 112. As shown in FIG. 11, the angle of the proximal end 27 is between 90 degree to 1 degrees from the longitude axis of the blade 112 creating a milling fan blade 63. The milling fan blade 63 creates a high pressure on the outer most concentric row of blades 112 on the rotational grinding disc 104 and a low pressure on the inner concentric row of blades 112. This pressure difference causes the air and grain to flow from the blades 112 and out a discharge port 58.

Figure 12:
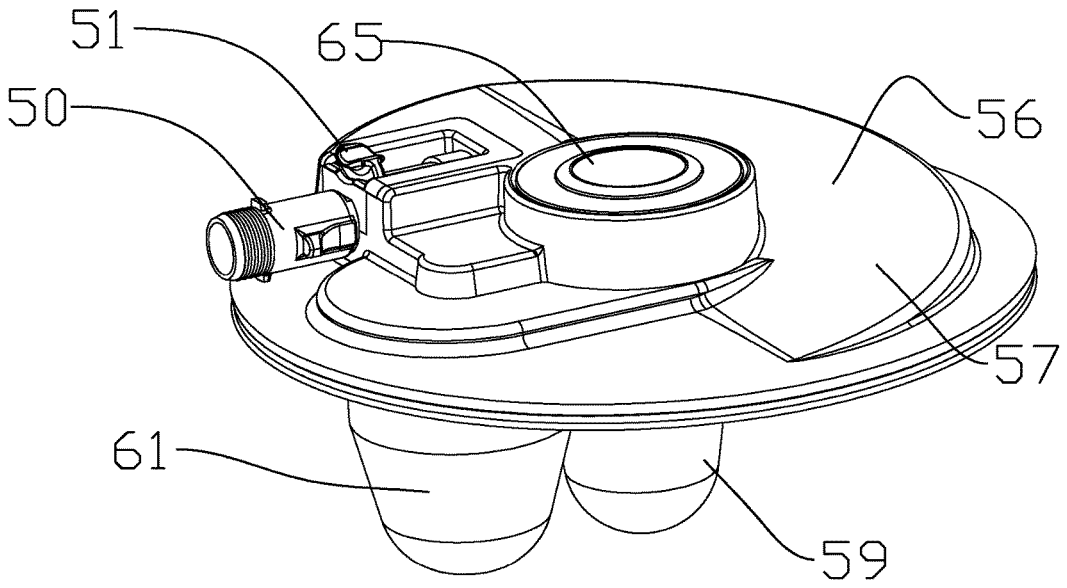
FIG. 12 shows a side view of the collection container lid with the two cyclone air filters.
Figure 13:
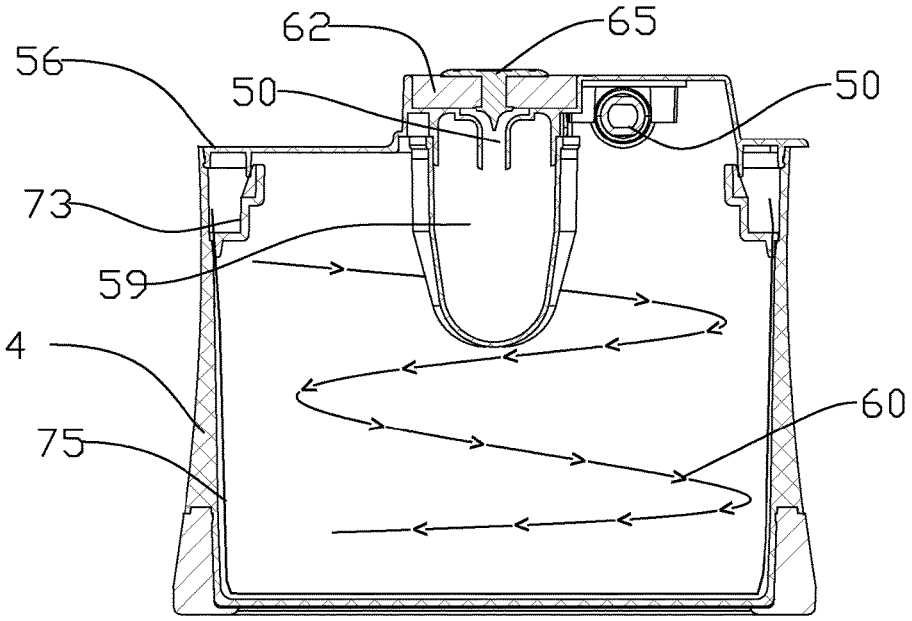
FIG. 13 shows a profile sectional view of the collection container and collection container lid in place and a cyclone air flow.

The discharge port 58 connects to a discharge conduit 50. The connection between the discharge port 58 and discharge conduit 50 forms an airtight seal, but is releasable by the user. As shown in FIGS. 1 and 12, the discharge conduit 50 is retractable into the container lid 56. FIG. 1 shows the discharge conduit 50, fully extended. FIG. 12. shows the discharge conduit 50 retracted into the container lid 56. When the mill 2 is in the storage configuration, the discharge conduit 50 is retracted. In an operation configuration, the discharge conduit 50 is extended. A locking mechanism 51 prevents the discharge conduit 50 from moving during operation or storage. The air and milled grain travel through the discharge conduit 50 to the collection container 4.

As illustrated in FIG. 1, the discharge conduit 50 connects to the container lid 56 at the outer edge of the circumference of the container lid 56, so as to be tangential to the circumferential interior of the collection container 4. Because of the tangential angle, the air and milled grain enter the collection container 4 and a helical or cyclonic flow pattern 60 develops around the inside diameter of the collection container 4. Those skilled in the art will appreciated that a cyclonic flow pattern 60 is a method of removing particles from air without the use of a traditional filters, through vortex separation.

To increase the cyclonic flow pattern 60, the container lid 56 has an incline 57 as shown in FIG. 12. The incline 57 forces the air and milled grain in a downward trajectory. The helical or cyclonic air flow pattern 60 also assists in distributing the grain evenly through the collection container 4.

Figure 14:
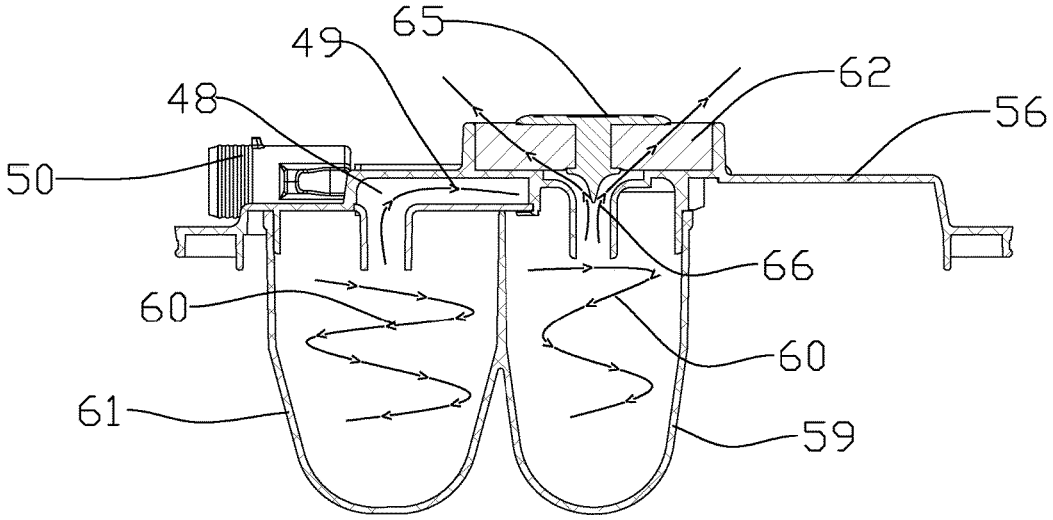
FIG. 14 shows a profile sectional view of the container lid, the two cyclone air filters and a foam air filter showing the airflow patterns through the cyclone air filters and foam filter.

As shown in FIG. 15, connected to the base of the container lid 56 is a first cyclone filter 61 and a second cyclone filter 59. Both utilizes a cyclonic air flow pattern 60 to remove particles from the air. As illustrated in FIG. 14, the first cyclone filter 61 and the second cyclone filter 59 may be a single unit. The connection of the first cyclone filter 61 and the second cyclone filter 59 to the container lid 56 forms an air tight connection, yet is still removable from the container lid 56.

The air and any remaining particles enters the first cyclone air filter 61. The air circulates around the first cyclone filter 61 in the cyclonic flow pattern 60. While flowing in a cyclonic flow pattern 60, the fine particles drop from the airflow and particles are stored in the base of the cyclone air filter 61. The air and any remaining grain particles travel from the first cyclone filter 61 through an air channel 49. The second cyclone filter 59 uses the same cyclonic flow pattern 60 described above for the first cyclone filter 61.

The virtually particle free air is then discharged through an air discharge outlet 66 located on the container lid 56. To ensure that the air is clean, a foam filter 62 is located in the discharge port 58. A filter plug 65 is inserted in the center of the foam filter 62, forcing the air to travel at an angle through the foam filter 62, therefore increasing the length the air must travel through the foam filter 62.

The finished milled grain is then fully captured in the collection container 4. The milled grained may be stored in the collection container 4. A bag 75 may be placed inside the storage container 4 to collect the milled grain which allows the user to easily removed the mill grain from the collection container 4. The bag 75 is held in place by a bag ring 73 located along the circumference of the collection container 4.

The mill 2 requires a constant airflow to operate. The milling process and operation of the motor 16 creates heat. Excess heat may damage the motor 16 and the mill 2. In addition, the heat may damage the nutritional value, and the taste as well as damage the texture of the grain. However, the motor 16 and milling assembly 22 are both a significant source of noise. Unlike the prior art, the current invention controls the flow of air through the mill housing 3 to dampen the noise. As shown in FIG. 4, a fan 70 located at the base of the motor 16 creates an airflow through the mill housing 3. Air is drawn into the mill housing 3 through a plurality of air intake ports 54 located around the circumference of the mill housing 3 to the first air chamber 72. Located around the first air chamber 72 are several sound baffles 74. The sound baffles 74 are made from foam material that absorbs any noise. As one skilled in the art would recognize, any material that absorbs noise may be utilized.

The air is then drawn around the mill assembly 22 and around the motor 16 cooling the mill assembly 22 and the motor 16. Located directly below the fan 70, is a second air chamber 76. Similar to the first air chamber 72, the second air chamber 76 has several sound baffles 74. The air flows to a third air chamber 78. The third air chamber 78 also contains several sound baffles 74. The airflow is discharged from the mill housing 3 through air vents 79 located on the base of the mill housing 3.

While a preferred embodiment of the invention of the grinding mill has been shown, and described herein, it should, however, be understood that the description above contains many specificities that should not be construed as limiting the scope of the invention. Thus, the scope of the embodiment should be determined by the appended claims and their legal equivalents thereof, rather than by the examples given.

What is claimed:

1. A grinding device for milling material comprising;

(a) a mill housing comprising a milling assembly and a discharge port, the discharge port for receiving a milled material from the milling assembly;

(b) a collection container having a container lid;

(c) a discharge conduit for linking the discharge port to the collection container;

whereby, the discharge conduit connects to the container lid near the outer circumference edge of the container lid at a tangential angle to the circumferential interior of the collection container; the tangential angle causes the milled material to enter the collection container resulting in a cyclonic flow pattern around the inside diameter of the collection container;

(e) the container lid has an incline for assisting in the creating of a cyclonic air flow pattern in the collection container;

whereby; the incline directs the milled material in a downward trajectory in the collection container;

(f) a first cyclone filter chamber and a second cyclone chamber position on the container lid for filtering mill grain particles from the air.

2. The device recited in claim 1, wherein the container lid includes a foam air filter.

3. The device recited in claim 2, wherein an air filter plug is located in the center of the foam filter causing the travel length of the air flow to increase through the air filter plug.

* * * * *